US007705796B2

(12) United States Patent
Park

(10) Patent No.: US 7,705,796 B2
(45) Date of Patent: Apr. 27, 2010

(54) DUAL OFFSET REFLECTOR SYSTEM UTILIZING AT LEAST ONE GIMBAL MECHANISM

(75) Inventor: Charles Y. Park, Palmdale, CA (US)

(73) Assignee: The Boeing Company, Chicago, IL (US)

( * ) Notice: Subject to any disclaimer, the term of this patent is extended or adjusted under 35 U.S.C. 154(b) by 365 days.

(21) Appl. No.: 11/769,603

(22) Filed: Jun. 27, 2007

(65) Prior Publication Data

US 2009/0002245 A1 Jan. 1, 2009

(51) Int. Cl.
*H01Q 13/00* (2006.01)
*H01Q 1/32* (2006.01)

(52) U.S. Cl. ..... 343/781 CA; 343/711

(58) Field of Classification Search ..... 343/781 R, 343/781 P, 781 CA, 840, 711
See application file for complete search history.

(56) References Cited

U.S. PATENT DOCUMENTS 6,342,865 B1 * 1/2002 Chandler et al. ..... 343/781 CA 6,441,794 B1 * 8/2002 Tang et al. ..... 343/781 CA

OTHER PUBLICATIONS

William A Imbrial, "Large Antennas of the Deep Space Network", Section 3.2, pp. 82-84.

* cited by examiner

*Primary Examiner*—Shih-Chao Chen
(74) *Attorney, Agent, or Firm*—Sawyer Law Group, P.C.

(57) ABSTRACT

A dual offset reflector system is disclosed. The system comprises a main reflector, a subreflector, a first gimbal mechanism for positioning of the subreflector. The system includes at least two feeds for receiving beams from the main reflector and the subreflector. One of the feds is at a focal point of the system and the other beam is displaced from the focal point. Accordingly, a simple solution to restore antenna gain reduction and avoid beam distortion due to the scan loss for a reflector system is provided that utilizes multiple feeds at different frequencies and polarizations. By placing the feeds at focal point trajectory of the subreflector whose positioning is controlled by a gimbal mechanism, a system is provided that minimizes distant and scan loss in a dual reflector system. The gimbal mechanism positions the subreflector so that a desired feed is in the focal point of the subreflector.

16 Claims, 9 Drawing Sheets

DUAL OFFSET REFLECTOR SYSTEM UTILIZING AT LEAST ONE GIMBAL MECHANISM

FIELD OF THE INVENTION

The present embodiment relates generally to a satellite system and more particularly to a dual offset reflector system utilized in a satellite system.

BACKGROUND OF THE INVENTION

Satellite systems supporting multiple missions require operation over multiple frequency bands. Separate antenna apertures cannot be used for each frequency band, due to the limited real estate on the satellite, so antennas must operate over multiple frequency bands.

Reflector antennas are often used on satellites for their mass efficiency and consist of one or more reflectors and feeds. Reflectors are inherently broadband, but multi-frequency feeds are complex and difficult to design and build. Using separate feeds for each frequency band reduces the feed complexity, however, when the feed is displaced from the reflector focal point, the beam is scanned from the mechanical boresight of the system and the gain of the antenna is reduced (called scan loss) resulting in degraded system performance.

Multi-frequency feed systems and frequency selective surfaces have been used to provide limited multiple frequency operation. Separate feeds operating at each frequency located side-by-side have also been used. Both of these systems have problems.

Multi-frequency feed systems are complex and difficult to build. Only a few feed systems have been developed for two or three frequency bands and are highly dependent on the frequency plan. If the frequencies are too close or the bandwidths are too broad, these feeds cannot be made to operate. Frequency selective surfaces (FSS's) have been designed to combine separate feeds to illuminate a common reflector. Like the multi-frequency feeds, FSS performance is highly dependent on the frequency plan. They also require significantly more volume and mass to implement.

Separate feeds located side-by-side is the simplest implementation with the least constraints on the frequency plan. However, when placed in conventional reflector systems, they suffer from beam scan and scan loss, as described above.

What is needed is a method and system that overcomes the above-identified issues. The present embodiment addresses this need.

SUMMARY OF THE INVENTION

A dual offset reflector system and method of use is disclosed. The system comprises a main reflector, a subreflector, a first gimbal mechanism for positioning of the subreflector. The system includes at least two feeds for receiving beams from the main reflector and the subreflector. One of the feeds is at a focal point of the system and the other beam is displaced from the focal point.

Furthermore, the dual offset reflector system can be utilized in a system comprising a vehicle; and an antenna system coupled to the vehicle. The antenna system includes a dual offset reflector system. The dual offset reflector system further comprises a main reflector and a subreflector. The reflector system includes a first gimbal mechanism for positioning of the subreflector and at least two feeds for receiving beams from the main reflector and the subreflector. One of two feeds is located at a focal point of the system and the other of two feeds is displaced from the focal point.

Accordingly, a simple solution to restore antenna gain reduction and avoid beam distortion due to the scan loss for a reflector system is provided that utilizes multiple feeds at different frequencies and polarizations. By placing the feeds at focal point trajectory of the subreflector whose positioning is controlled by a gimbal mechanism, a system is provided that minimizes shape distortion and scan loss in a dual reflector system. The gimbal mechanism positions the subreflector so that a desired feed is in the focal point of the subreflector. In addition, a second gimbal mechanism can be provided for a main reflector to control a direction of an output beam, particularly when forming a shaped beam.

The features, functions and advantages can be achieved independently in various embodiments of the present inventions or may be combined in yet other embodiments.

DETAILED DESCRIPTION

The following description is presented to enable one of ordinary skill in the art to make and use the embodiment and is provided in the context of a patent application and its requirements. Various modifications to the embodiments and the generic principles and features described herein will be readily apparent to those skilled in the art. Thus, the present embodiment is not intended to be limited to the embodiments shown, but is to be accorded the widest scope consistent with the principles and features described herein.

Figure 1:
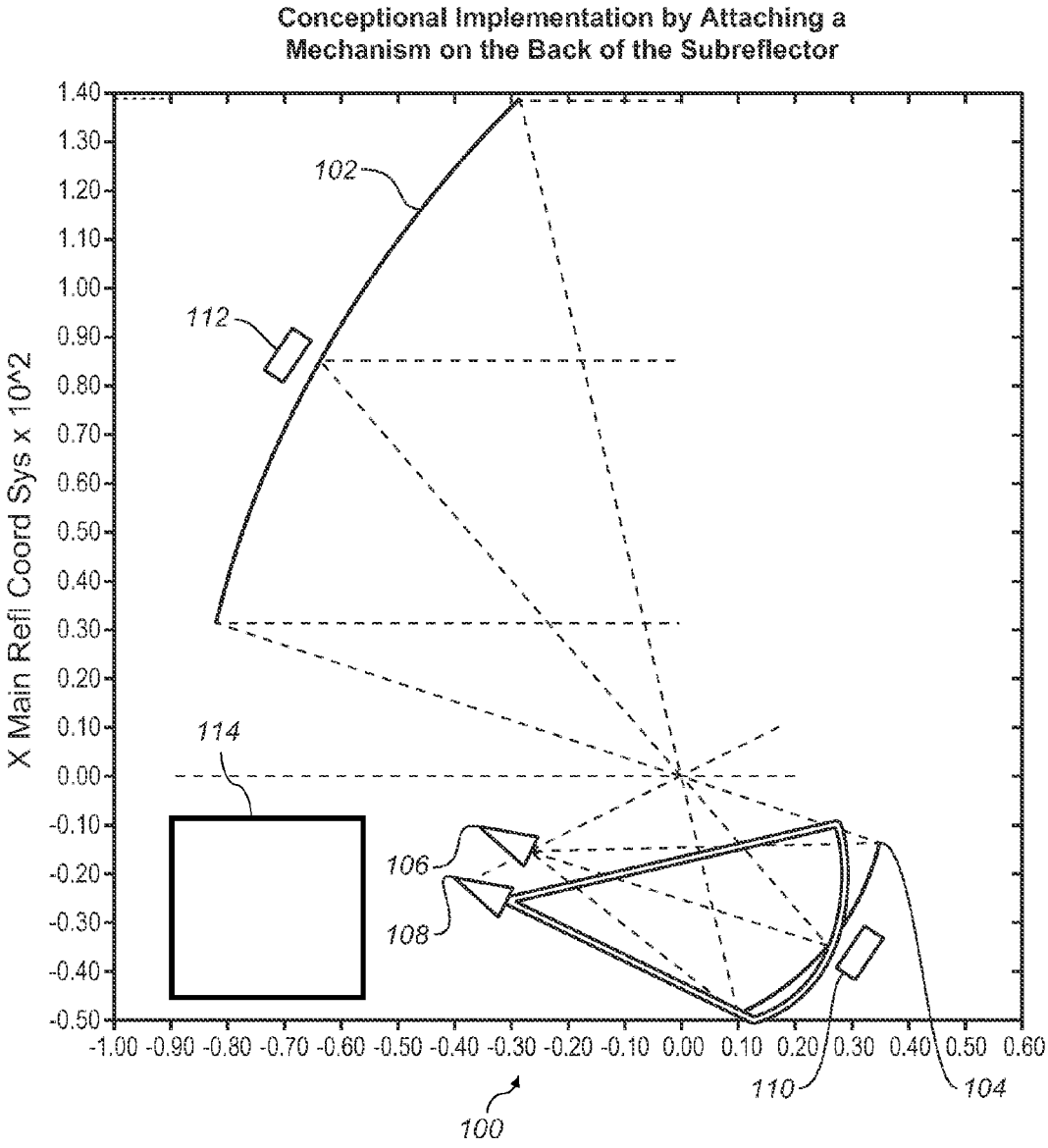
FIG. 1 is an embodiment of a dual reflector system in accordance with the present embodiment.

FIG. 1 is an embodiment of a dual offset reflector system 100. This reflector system 100 is utilized as part of an antenna system for a variety of vehicles 114 coupled to the reflector system 100, such as satellites to detect objects on a body such as the earth. The reflector system 100 includes a main reflector 102 and a subreflector 104. The embodiment allows the gimballing of the subreflector 104 and the main reflector 102 in a dual surface reflector antenna system by attaching gimbaling mechanisms of the subreflector and the main reflector. The implementation of the embodiment is shown in a dual Gregorian reflector antenna system with 107" diameter main reflector whose focal length is 85". The antenna system includes a feed 106 at the focal point of the subreflector and a feed 108 that is laterally displaced. The tilting of the subreflector 104 moves the focal point of the subreflector 104 and the tilting of the main reflector 102 moves the focal point of the main reflector 102.

The alignment of the focal point of the subreflector 104 and the laterally displaced feed results in the mispointed beam to come back to the boresight and the reduced gain to be recovered. Also the tilting of the main reflector 102 aligns the focal axis of the main reflector 102 with that of the subreflector 104.

The separate feeds 106 and 108 for each frequency or polarizations are located side-by-side and a first and second gimbal mechanism is located behind subreflector 104 and the main reflector 102, respectively. The gimbal mechanism 110 tilts the subreflector from its nominal position, thereby restoring the antenna gain reduction and beam shape distortion caused by scan loss. The system performance is therefore significantly improved. At the same time, the beam returns to the original mechanical boresight direction, even though the feed is still laterally displaced.

In case of a pencil shaped beam application, mechanical boresight restoration is achieved through the tilting of the subreflector 104. By utilizing the gimbal mechanism 110 on the main reflector 104, the pencil beam can be scanned from, the mechanical boresight with high efficiency. In case of a highly shaped beam application such as a CONUS shaped beam, the restoration is achieved, through the tilting of the main reflector 102 via gimbal mechanism 112, in addition to the tilting of the subreflector 104.

The dual offset reflector system 100 allows use of a single reflector aperture for multiple frequency band or multiple polarization operation where only one band or polarization is operational at any given time and it reduces the need for multiple reflector antenna apertures on the spacecraft. This functionality of multi frequency band and polarization operation is achieved without the need for a new hardware development, such as a frequency selective surface (FSS). The number of feeds and, therefore, the number of bands or polarization that can be used is not limited by the FSS or feed design. To describe the features of the system in more detail, refer now to the following description in conjunction with the accompanying FIGS.

Figure 2:
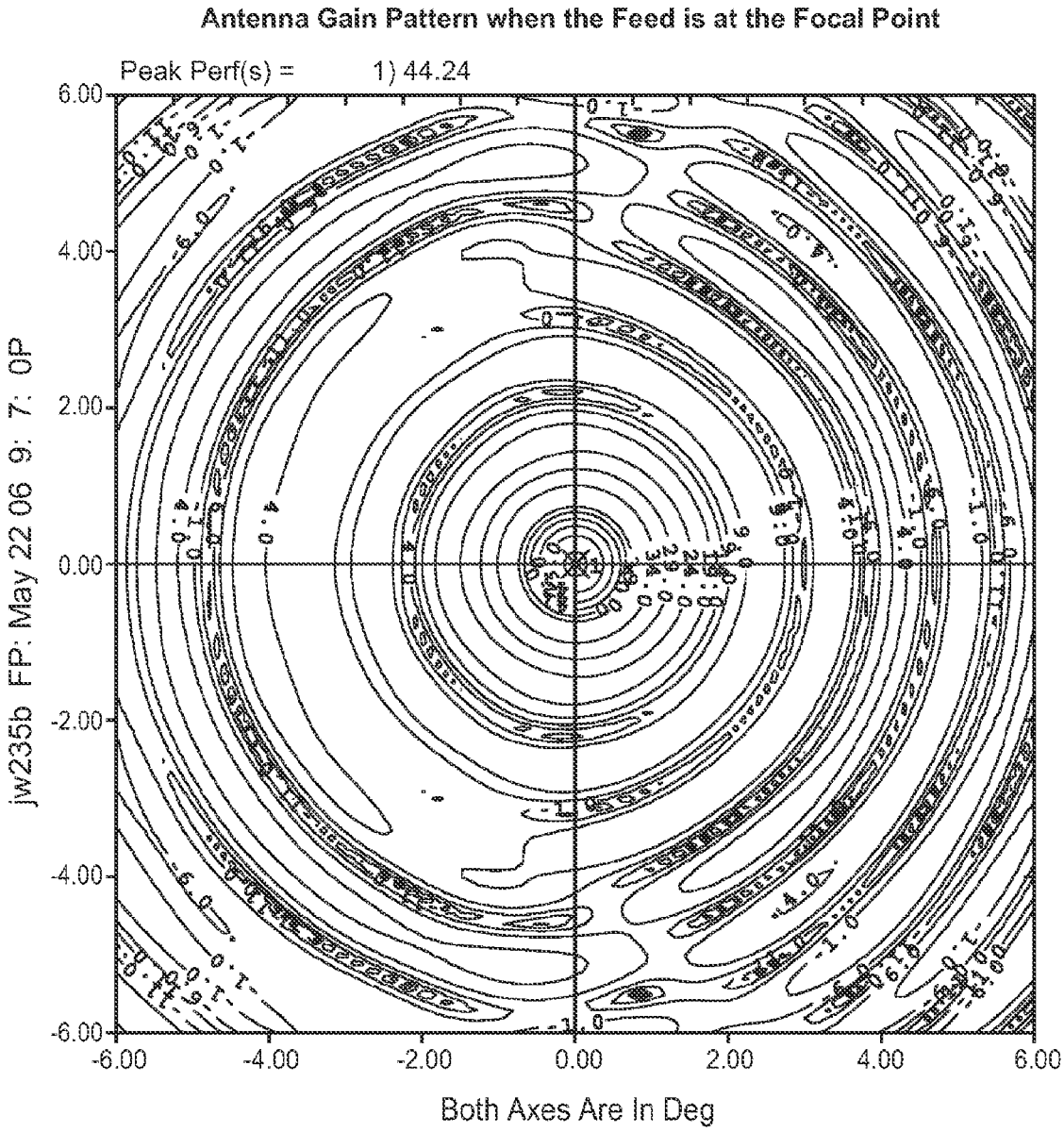
FIG. 2 Illustrates an antenna gain pattern when the feed is at the focal point FIG. 3 Illustrates an antenna gain pattern when the feed is displaced.
Figure 3:
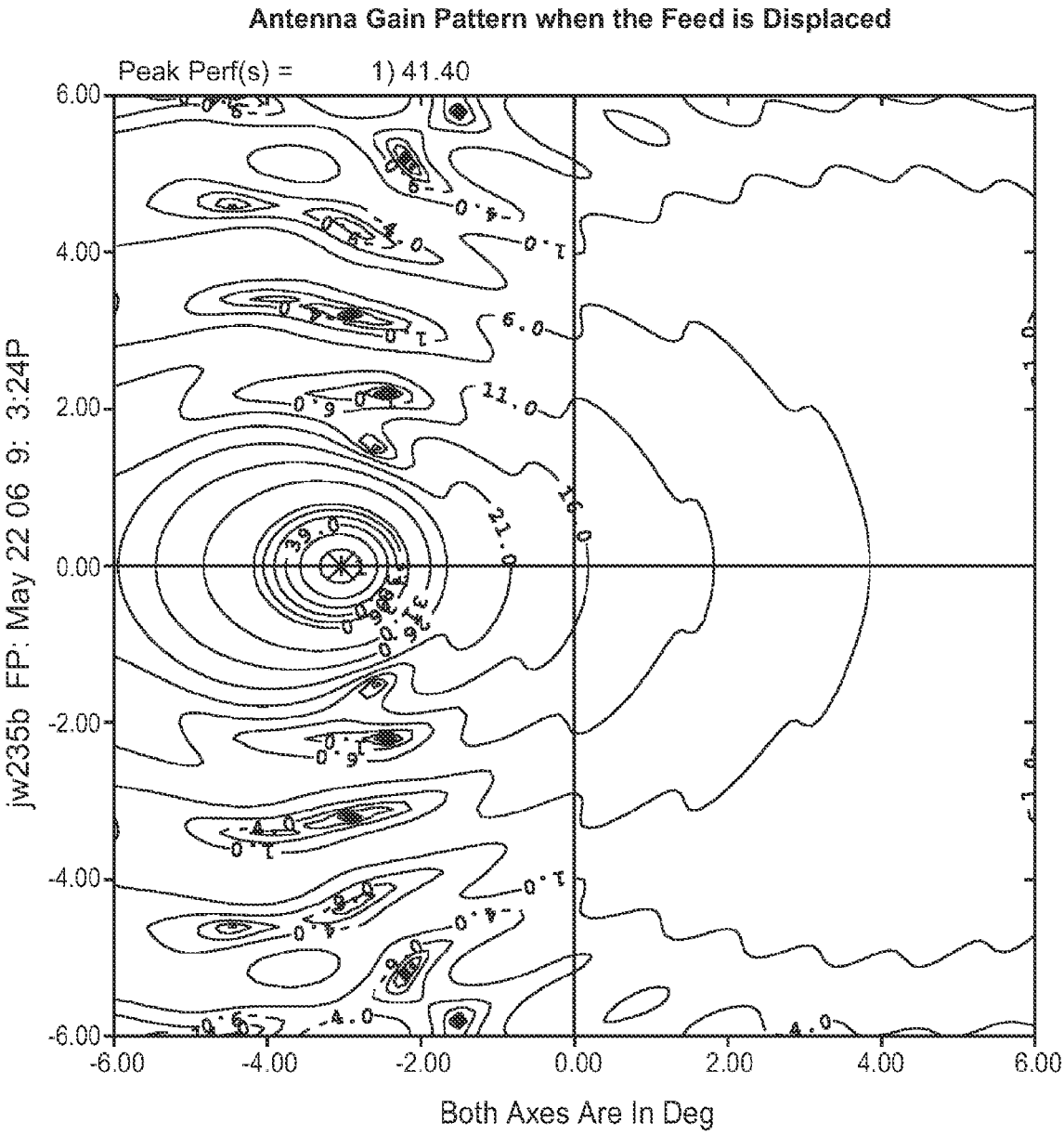
Figure 4:
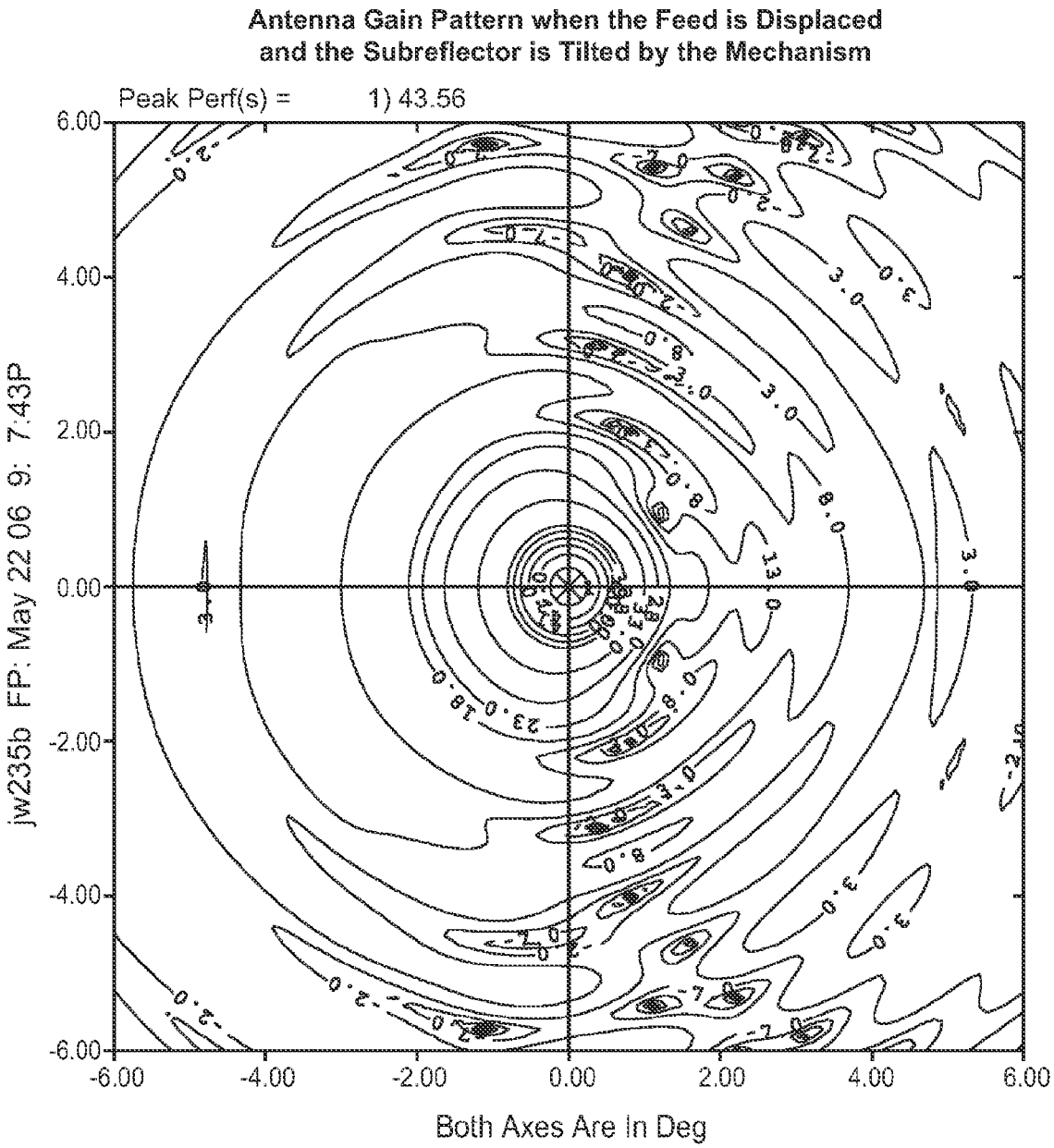
FIG. 4 Illustrates an antenna gain pattern when the feed is displaced and the subreflector is tilted by the mechanism.

First the functional description for providing a pencil shaped beam utilizing the dual reflector system is provided herein. When feed 106, operating at frequency-2, is at the focal point, the gain of the antenna is highest as shown in FIG. 2. When feed 108, operating at frequency-2, is displaced laterally from the focal point by 7.7" for example as shown in FIG. 1, the antenna gain is reduced, and the beam is mispointed as shown in FIG. 3. With the rotation of the subreflector 104, the focal point of the subreflector 104 can be pointed toward the displaced feed and the gain of the beam and its mispointing is recovered, as shown in FIG. 4. Feed 108 can be displaced, in any direction from the focal point and the same operation can be applied with similar results. There can be many feeds near and around the focal point at different frequency bands and the subreflector 104 can be tilted to point its focal point at them. Once the mechanical boresight is restored, the beam can be steered in any direction with the rotation of the main reflector 104. The described operation works in the same manner when the feed 108 operates at frequency-1.

Figure 5:
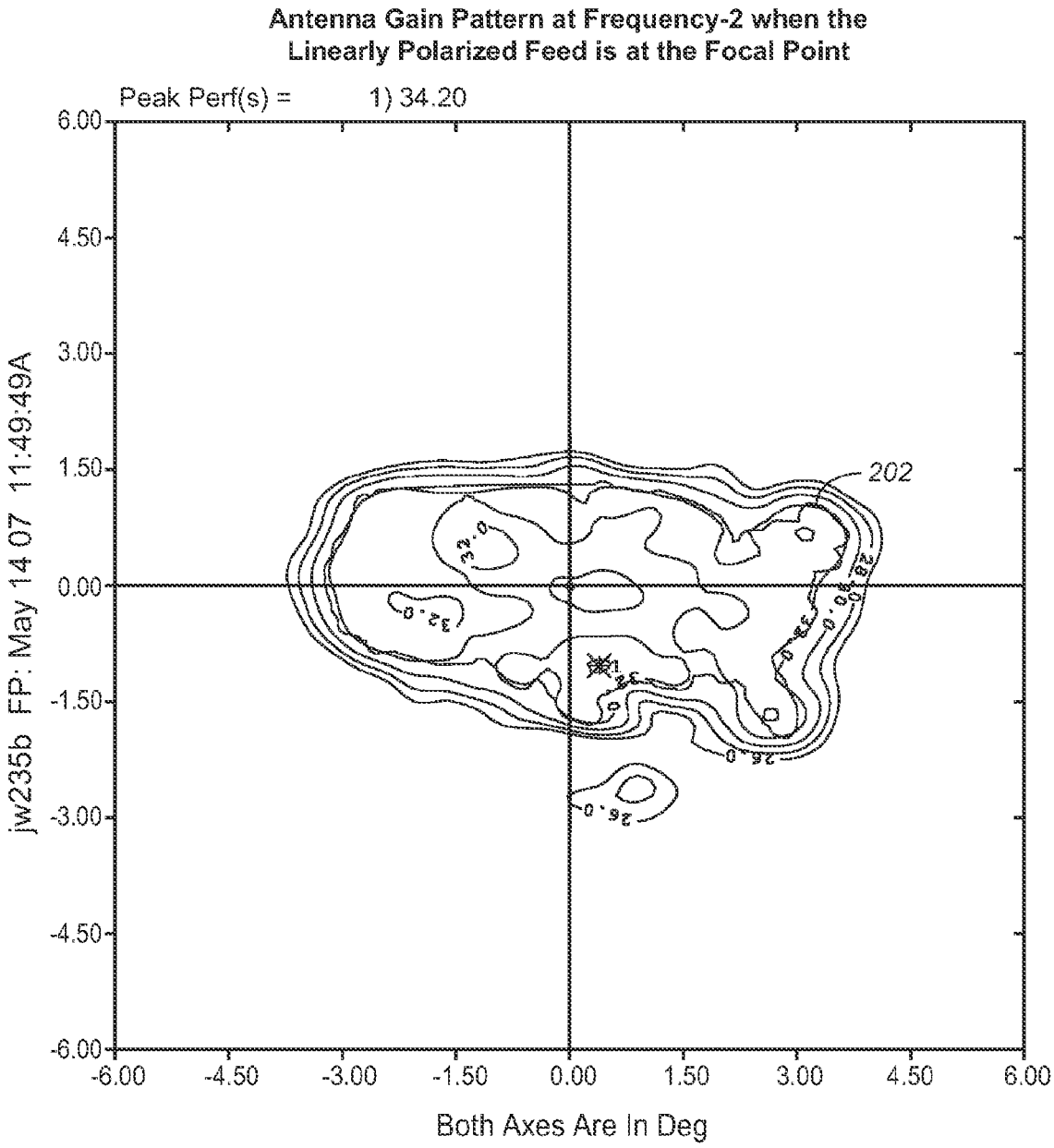
FIG. 5 Illustrates an antenna gain pattern at frequency-2 when the linearly polarized feed is at the focal point.
Figure 6:
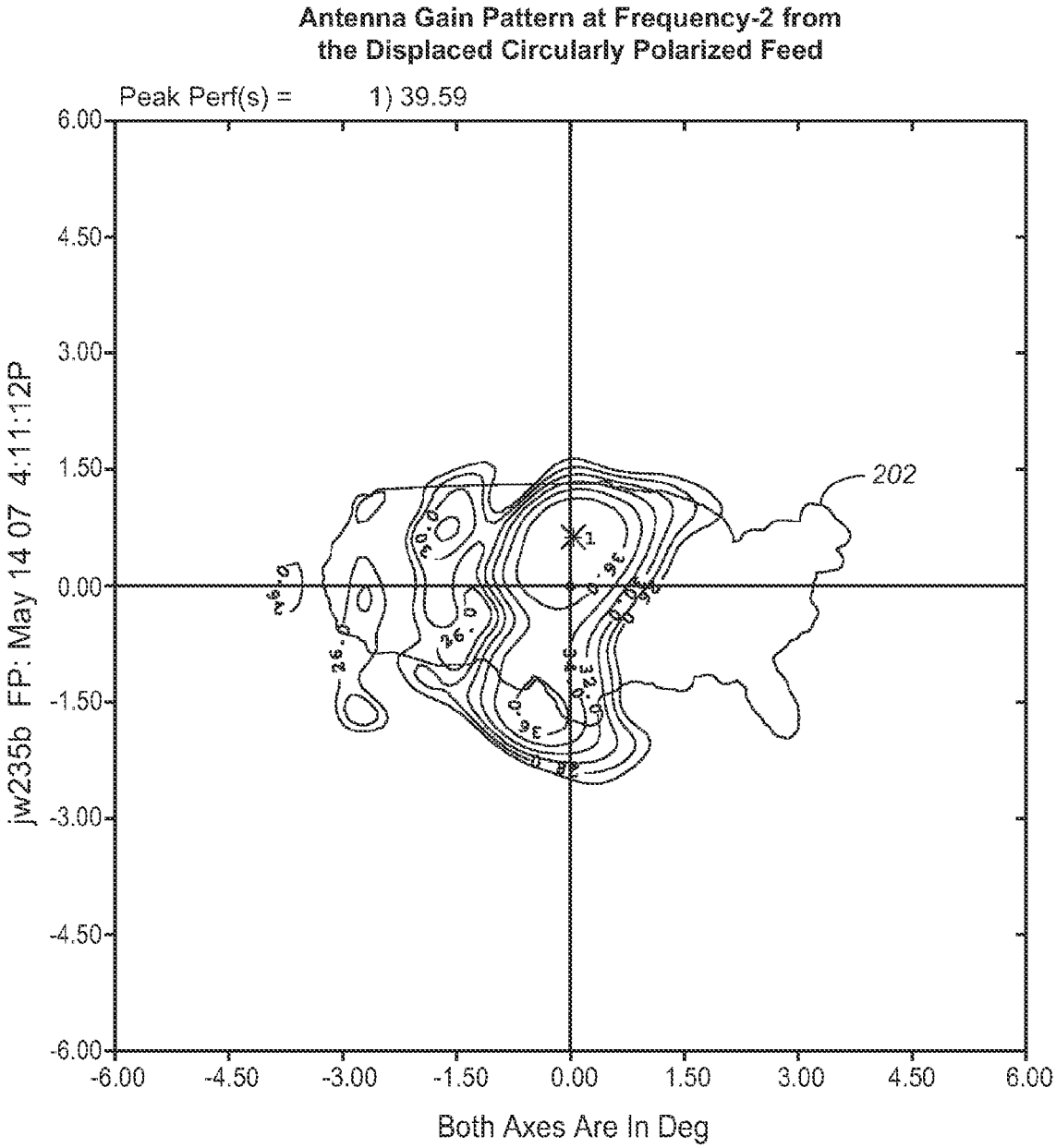
FIG. 6 Illustrates an antenna gain pattern at frequency-2 from the displaced circularly polarized feed.
Figure 7:
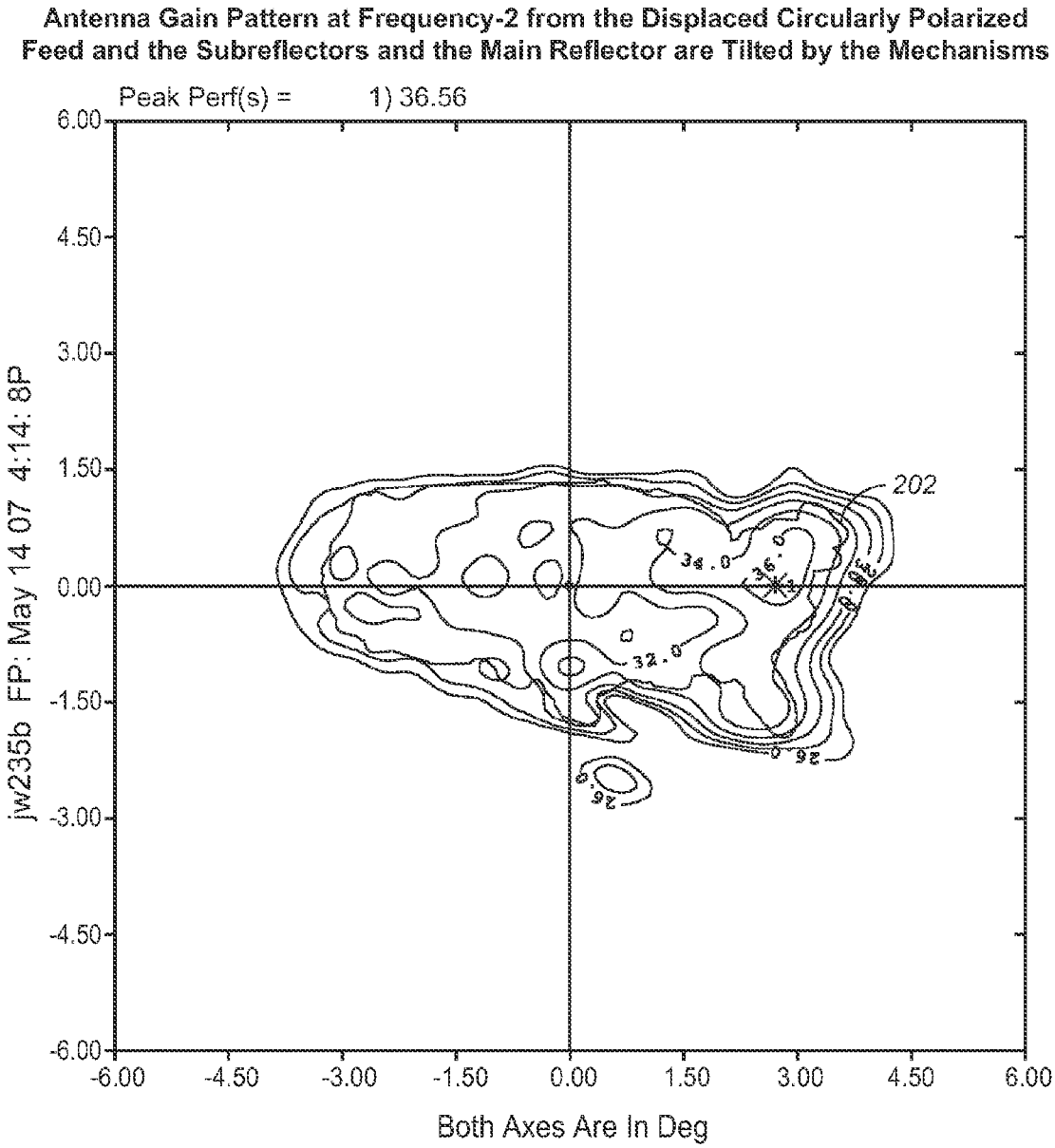
FIG. 7 Illustrates an antenna gain pattern at frequency-2 from the displaced circularly polarized feed and the subreflector and the main reflector are tilted by the mechanisms.

A first functional description for the case of a highly shaped beam application is now provided here using two feeds with the same frequency, frequency-1 but with two different polarizations. In this embodiment as shown in FIG. 5, the shape 202 approximates the shape of the United States. When feed 106, operating at linear polarization, is at the focal point, the shape of the antenna beam is optimum as shown in FIG. 5. When feed 108, operating at left-hand circular polarization, is displaced laterally from the focal point by 7.7" for example as shown in FIG. 1, the antenna beam shape is highly distorted and the beam is mispointed as shown in FIG. 6. With the rotation of the subreflector 104 and the main reflector 102, the focal point of the subreflector 104 can be pointed toward, the displaced feed 108 and to that of the main reflector 102. The shape of the beam and its mispointing is recovered as shown in FIG. 7.

Figure 8:
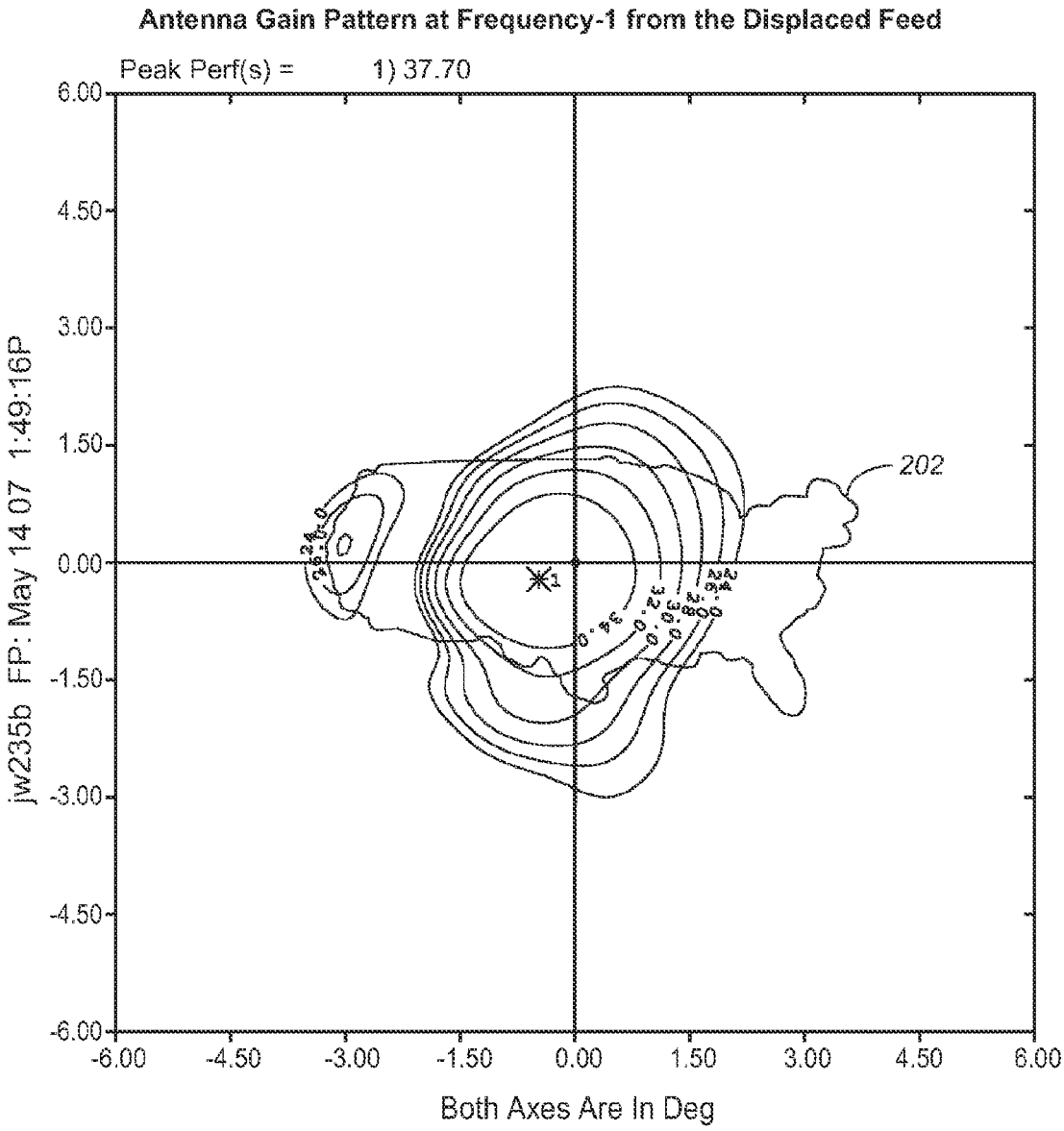
FIG. 8 Illustrates an antenna gain pattern at frequency-1 from the displaced feed.
Figure 9:
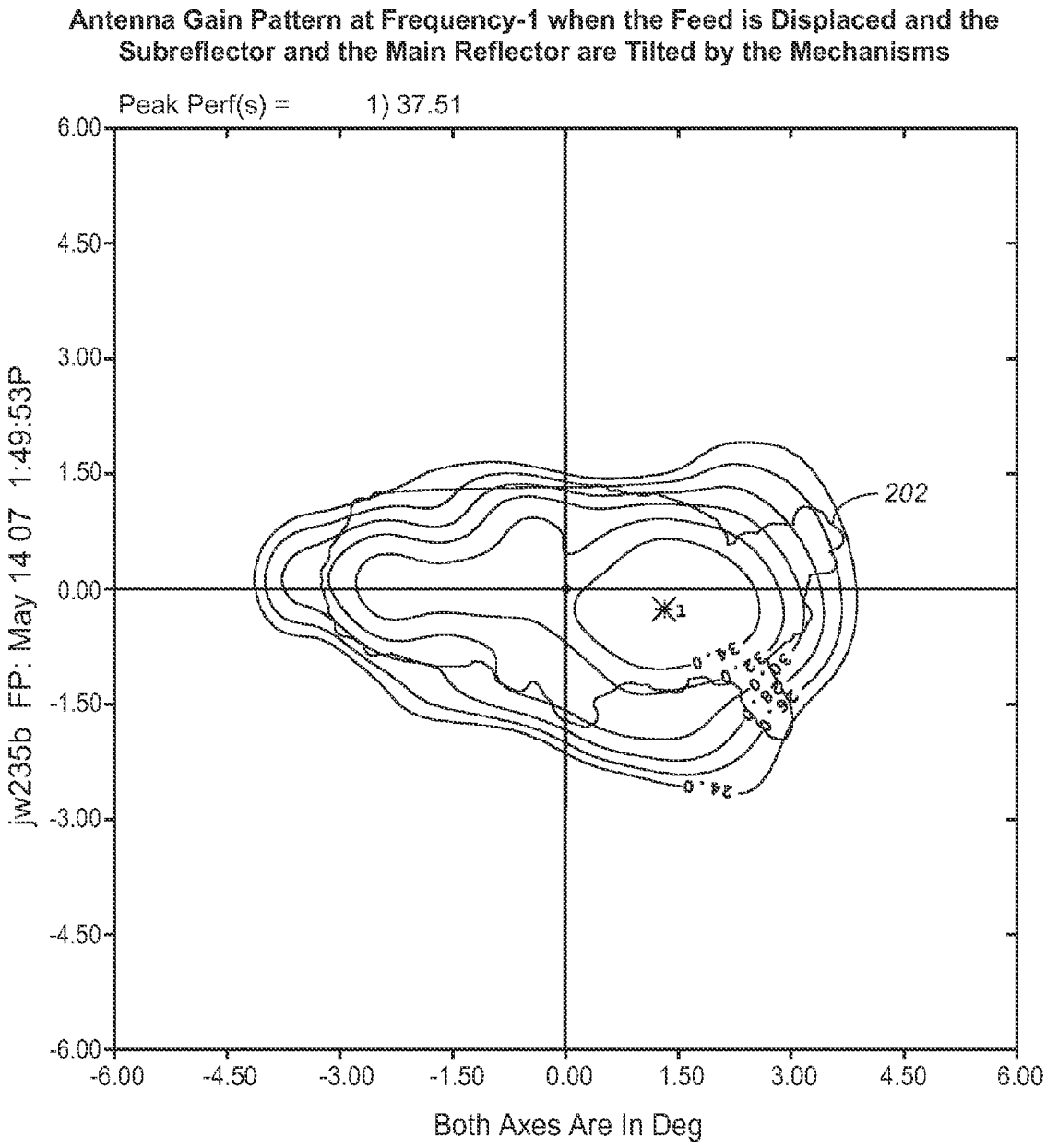
FIG. 9 Illustrates an antenna gain pattern at frequency-1 when the feed is displaced and the subreflector and the main reflector are tilted by the mechanisms.

A second functional description for the case of highly shaped beam application is given here using two feeds with two different frequencies. When the feed 106, operating at frequency-1, is at the focal point, the shape of the antenna beam is optimum as shown in FIG. 5. When the feed. 108, operating at frequency-2, is displaced laterally from, the focal point by 7.7" for example as shown in FIG. 1, the antenna beam, shape is highly distorted and the beam is mispointed as shown in FIG. 8. With the rotation of the subreflector 104 and the main reflector 102, the focal point of the subreflector can be pointed toward the displaced feed and to that of the main reflector. The shape of the beam and its mispointing is recovered as shown in FIG. 9.

Advantages

1. Independent tilting of the subreflector and the main reflector utilizing separate gimbal mechanisms.
2. Existing hardware and manufacturing techniques can be used to provide the dual offset reflector system.
3. Can be utilized in a dual offset reflector antenna system that can be implemented on the satellites for multi-band operation with a single aperture pencil and shaped beam application when only operation at one band is required.
4. Customers can re-configure the operating frequency or the polarization while the satellite is in orbit with the same antenna pattern coverage region requirement.

CONCLUSION

A dual offset reflector system in accordance with an embodiment can be utilized with multiple feeds covering different frequency bands that can be placed around the focal axis of the subreflector side-by-side. The system includes a main reflector and a subreflector that can be positioned, by a gimbal mechanism. The gimbal mechanism can position the subreflector at a focal point for each feed. In so doing, shape distortion and scan loss is minimized. The number of feeds, and therefore the number of frequency bands, is only limited by the physical constraints caused by the size of the feed horns. In addition, in one embodiment, multiple feeds with linear and circular polarization can be also placed allowing switching between linearly and circularly polarized feeds.

Although the present embodiment has been described in accordance with the embodiments shown, one of ordinary skill in the art will readily recognize that there could be variations to the embodiments and those variations would be within the spirit and scope of the present embodiment. Accordingly, many modifications may be made by one of ordinary skill in the art without departing from the spirit and scope of the appended claims.

What is claimed is:

1. A dual offset reflector system comprising:

a main reflector;

a subreflector;

a first gimbal mechanism for positioning of the subreflector;

at least two feeds for receiving beams from the main reflector and the subreflector, one of two feeds being located at a focal point of the system and the other of two feeds being displaced from the focal point; and a second gimbal mechanism for positioning of the main reflector, wherein the first and second gimbal mechanisms position the subreflector and the main reflector independently of each other.

2. The system of claim 1 wherein each of the at least two feeds are placed approximately at focal point trajectory of the subreflector.

3. The system of claim 1 wherein each of the at least two feeds operate at different frequencies.

4. The system of claim 1 wherein each of the at least two feeds have different polarizations.

5. The system of claim 1 wherein the subreflector is positioned to provide a pencil shaped beam.

6. The system of claim 1 wherein both the main reflector and subreflector are positioned to provide a highly shaped beam.

7. A system comprising:

a vehicle; and an antenna system coupled to the vehicle;

the antenna system including a dual offset reflector system; the dual offset reflector system further comprising a main reflector, a subreflector, a first gimbal mechanism for positioning of the subreflector; at least two feeds for receiving beams from the main reflector and the subreflector, one of two feeds being located at a focal point of the system and the other of two feeds being displaced from the focal point; and a second gimbal mechanism for positioning of the main reflector, wherein the first and second gimbal mechanisms position the subreflector and the main reflector independently of each other.

8. A system of claim 7 wherein each of the at least two feeds are placed approximately at focal point trajectory of the subreflector.

9. The system of claim 7 wherein each of the at least two feeds operate at different frequencies.

10. The system of claim 7 wherein each of the at least two feeds have different polarizations.

11. The system of claim 7 wherein the subreflector is positioned to provide a pencil shaped beam.

12. The system of claim 7 wherein both the main reflector and subreflector are positioned to provide a highly shaped beam.

13. A method for improving a dual offset reflector system comprising:

providing a main reflector;

providing a subreflector;

providing a first gimbal mechanism for positioning of the subreflector; and providing at least two feeds for receiving beams from the main reflector and the subreflector, one of two feeds being located at a focal point of the system and the other of two feeds being displaced from the focal point, and a second gimbal mechanism for positioning of the main reflector, wherein the first and second gimbal mechanisms position the subreflector and the main reflector independently of each other.

14. The method of claim 13 wherein each of the at least two feeds are placed approximately at focal point trajectory of the subreflector.

15. The method of claim 13 wherein each of the at least two feeds operate at different frequencies.

16. The method of claim 13 wherein each of the at least two feeds have different polarizations.

* * * * *